US005494268A

United States Patent [19]

Heintz

[11] Patent Number: 5,494,268

[45] Date of Patent: Feb. 27, 1996

[54] COMBINATION CHAIN WRENCH AND VISE

[76] Inventor: Farrell E. Heintz, 3319 B S. Monaco Pkwy., Denver, Colo. 80222

[21] Appl. No.: 258,559

[22] Filed: Jun. 10, 1994

Related U.S. Application Data

[63] Continuation-in-part of Ser. No. 13,783, Feb. 5, 1993, Pat. No. 5,320,021.

[51] Int. Cl.[6] ..... B25B 5/14

[52] U.S. Cl. ..... 269/69; 269/130

[58] Field of Search ..... 269/95–97, 99, 269/130–132, 88, 101, 902, 69

[56] References Cited

U.S. PATENT DOCUMENTS

| | | | |
|---|---|---|---|
| 1,054,958 | 3/1913 | Amborn | 269/132 |
| 1,665,182 | 4/1928 | Sutthery | 269/132 |
| 2,984,132 | 5/1961 | Renz | 269/130 X |
| 3,379,431 | 4/1968 | Gill | 269/130 |
| 4,415,149 | 11/1983 | Rees | 269/88 |
| 5,228,607 | 7/1993 | Tolsdorf | 269/97 X |

*Primary Examiner*—D. S. Meislin
*Attorney, Agent, or Firm*—Edwin H. Crabtree; Donald W. Margolis; Ramon L. Pizarro

[57] ABSTRACT

A combination chain wrench and vise for holding a workpiece, such as a pipe and like object, in place and for engagement around a circumference of the workpiece and performing work thereon. A first chain wrench is disposed at a right angle to the length of the workpiece and includes a chain wrench body with the front of wrench body having a plurality of teeth for releasably engaging and gripping of the workpiece. A first end of a chain is adapted for tightening on the chain wrench body. A second end of the chain is releasably mounted on the chain wrench body so that a length of the chain can be adjusted when received around different sizes of the workpiece. The wrench body further includes a first attachment block extending outwardly from the top of the wrench body. The first attachment block is adapted for receipt inside a first end of a vise attachment tube. The vise attachment tube is mounted to the top of a vise base. The vise base may be secured on the top of a work bench, service truck bumper and on a portable stand adapted for attachment to a ball hitch at the rear of a service truck. A second chain wrench with a chain wrench body having a first attachment block may be received in a second end of the vise attachment tube so that a pair of wrench bodies with adjustable chains may be used for gripping the workpiece.

16 Claims, 2 Drawing Sheets

COMBINATION CHAIN WRENCH AND VISE

This application is a continuation-in-part application of patent application Ser. No. 08/013,783, filed on Feb. 5, 1993, by the subject inventor and having a title of "UNIVERSAL CHAIN WRENCH AND TOOLS". Application having Ser. No. 08/013,783 will issue on Jun. 14, 1994 having U.S. Pat. No. 5,320,021.

BACKGROUND OF THE INVENTION (a) Field of the Invention

This invention relates to a chain wrench and vise and more particularly, but not by way of limitation, to a portable chain wrench and vise combined for working on different types of workpieces. The chain wrench and vise may be secured to on a work bench, vehicle bumper, on a portable stand attached to a ball hitch at the rear of the vehicle and other similar applications.

(b) Discussion of Prior Art

In U.S. Pat. Nos. 1,456,290 to Tell, 2,825,253 to Brenner, 4,987,804 to Greenawalt, 3,880,024 to Asada, 3,597,776 to Saunders, 2,932,226 to Seppola and 511,907 to Bates different types of adjustable chain wrenches and clamping wrenches are disclosed. None of these prior art patents specifically disclose the unique features and structure of the subject portable chain wrench and vise as described herein.

SUMMARY OF THE INVENTION

In view of the foregoing, it is a primary object of the invention to provide a chain wrench which can be quickly attached to a vise for securing a workpiece in place and performing work on the workpiece such as tightening and loosening threaded pipe fittings and other work objects.

Another object of the present invention is the chain wrench and vise are portable and can be mounted on a workbench, on a bumper of a vehicle, on a portable stand having a ball socket for releasable attachment of a ball hitch mounted on the rear of a vehicle and on other work areas.

Still another object of the combination chain wrench and vise is the vise can be used to receive one chain wrench for securing the work piece or the vise can be used to receive two chain wrenches for securing the work piece. The invention can easily be set up and used by a single operator.

The invention is rugged and compact, easy to store and transport and can be used in a variety of applications for working on different types of objects requiring a chain wrench and vise.

The combination chain wrench and vise includes a first chain wrench. The first chain wrench has a chain wrench body with the front of wrench body having a plurality of teeth for releasably engaging and gripping the workpiece. A first end of a chain is adapted for tightening on the chain wrench body. A second end of the chain is releasably mounted on the chain wrench body so that a length of the chain can be adjusted when received around different sizes of the workpiece. The chain wrench body further includes a first attachment block extending outwardly from the top of the wrench body. The first attachment block is adapted for receipt inside a first end of a vise attachment tube. The vise attachment tube is mounted to the top of a vise base. The vise base may be secured on top of a work bench, vehicle bumper and on a portable stand adapted for attachment to a ball hitch at the rear of the vehicle. A second chain wrench having a chain wrench body with a first attachment block may be received in a second end of the vise attachment tube so that a pair of chain wrench bodies with adjustable chains may be used for gripping the workpiece.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 2 is a perspective view of portable chain wrench and vise with the first chain wrench and a second chain wrench in position for attachment to vise mounted on a work bench or the like.

DESCRIPTION OF THE PREFERRED EMBODIMENTS

Figure 1:
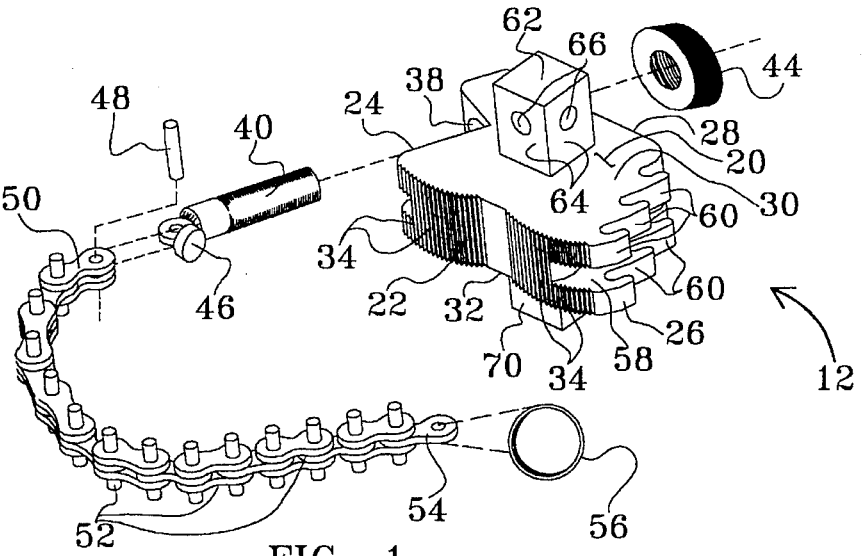
FIG. 1 perspective view of a first chain wrench which is part of the portable chain wrench and vise shown in FIG. 2.
Figure 2:
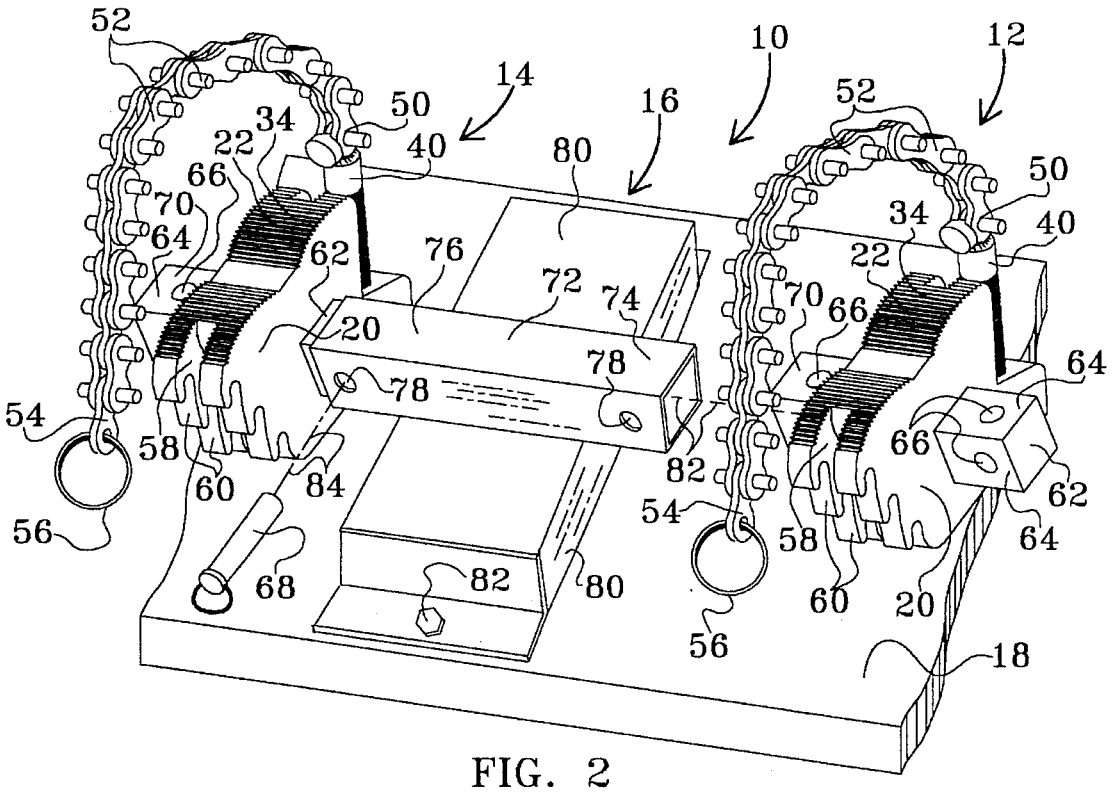

Referring to both FIG. 1 and FIG. 2, the portable combination chain wrench and vise is shown having general reference numeral 10. The chain wrench and vise 10 includes a first chain wrench 12, shown in detail in FIG. 1, a second chain wrench 14 which is identical in structure and function when compared to the first chain wrench 12 and a vise housing 16 mounted on a work bench 18. The chain wrench and vise 10 may be used in a variety of ways and mounted on vehicle bumpers, tables and other surfaces for performing work on a workpiece.

Figure 4:
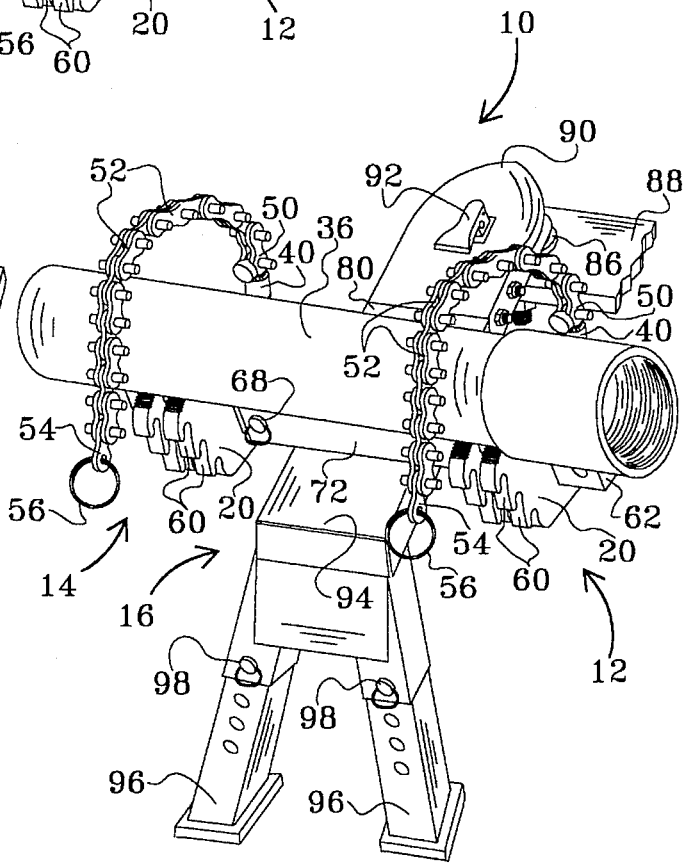
FIG. 4 is a perspective view of the portable chain wrench and vise attached to the ball hitch mounted on the rear of a vehicle with the first and second chain wrenches ready for securing a threaded pipe workpiece thereto and performing work thereon.

Referring back to FIG. 1, the first chain wrench 12 includes a chain wrench body 20 having a front portion 22, a first side portion 24, a second side portion 26, a rear portion 28, a top portion 30 and a bottom portion 32. The front portion 22 of the wrench body 20 includes a plurality of teeth 34 for releasably engaging and gripping a workpiece 36 as shown in FIG. 4. The first side portion 24 includes an adjustment bolt hole 38 for receiving an adjustable chain tightener bolt 40 which is attached to a knurl nut 44. The knurl nut 44 is used to tighten the bolt 40 on the wrench body 20. The bolt 40 includes a bolt guide 46 and a chain pin 48 used to secure a first end 50 of a chain 52 thereto. The chain 52 is designed for receipt around workpieces having different diameters and includes a second end 54 having a keeper ring 56 used to guide the chain 52 through a chain groove 58 in the second side portion 26 of the wrench body 20. The second end 54 of the chain 52 is attached to one of a plurality of hooks 60 in the second side portion 26. When the chain 52 has been received around a workpiece and the second end 54 secured to a selected hook 60, the knurl nut 44 is tightened on the chain tightener bolt 40 and the workpiece is secured to the first chain wrench 12.

The first chain wrench 12 also includes a first attachment block 62 extending upwardly from the top portion 30 of the first chain wrench body 20. The first attachment block 62 includes exterior sides 64 with attachment pin holes 66 for receiving attachment pins 68. One of the attachment pins 68 is shown in FIG. 2. Further, the first chain wrench 12 includes a second attachment block 70 extending downwardly from the bottom portion 32 of the first chain wrench body 20. The second attachment block 70 being similar in structure to the first attachment block 62 also includes exterior sides 64 with attachment pin holes 66 for receiving attachment pins 68. Only a portion of the second attachment block 70 is shown in FIG. 1. The first and second attachment blocks 62 and 70 are used for various types of chain wrench handles and in the subject invention are used for securing the first and second chain wrenches 12 and 14 to a portion of the vise housing 16 as shown in FIG. 2.

In FIG. 2, the vise housing 16 includes a vise attachment tube 72 having a first end 74 and a second end 76. The first and second ends 74 and 76 includes attachment pin holes 78 for receiving one of the attachment pins 68 therethrough. The vise attachment tube 72 is mounted laterally on top of a vise base 80. The vise base 80 is secured to the work bench 18 using bolts 82 or like fasteners.

In operation when using the combination chain wrench and vise 10, the vise base 80 is mounted on the work bench 18 or other flat working surface such as a service vehicle bumper, work table and the like. The first chain wrench 12 and the second chain wrench 14 are removed from a tool kit, not shown in the drawings, and using either the first attachment block 62 or the second attachment block 70 the chain wrenches 12 and 14 are secured to the opposite ends of the vise attachment tube 72 using the attachment pins 68. It should be noted that the structure of the second chain wrench 14 is identical to the first chain wrench 12 and both wrenches can be used interchangeably when attached to the vise attachment tube 72. The chains 52 are then received around a workpiece and the second end 54 of the chains 52 releasably attached to a selected hook 60. The chain tightener bolt 40 is then tightened using the knurl nut 44 and the workpiece is securely held on the chain wrench and vise 10. It should be noted that in some work situations only one of the chain wrenches attached the vise housing 16 may be required for performing work on the workpiece.

In FIG. 2, the first chain wrench 12 is shown in position for the second attachment block 70 to be inserted, as indicated by dotted lines 82, into the first end 74 of the vise attachment tube 72. The first attachment block 62 of the second chain wrench 14 has already been inserted into the second end 76 of the vise attachment tube 72. An attachment pin 68 is shown in position to be inserted, as indicated by dotted lines 84, through attachment pin hole 78 thereby securing the second chain wrench 14 to the vise attachment tube 72. As seen in this drawing, the vise attachment tube 72 is angular in shape with the first and second ends 74 and 76 adapted for receiving the four exterior sides 64 of the attachment blocks 62 and 70. By the nature of the angular construction of the vise attachment tube 72, the attachment blocks 62 and 70 will be held therein in a press fit and will not allow the wrench body 20 to turn or rotate when using the chain wrench and vise 10. Obviously, the attachment pins 68 prevent the attachment blocks 62 and 70 from being removed from the tube 72.

Figure 3:
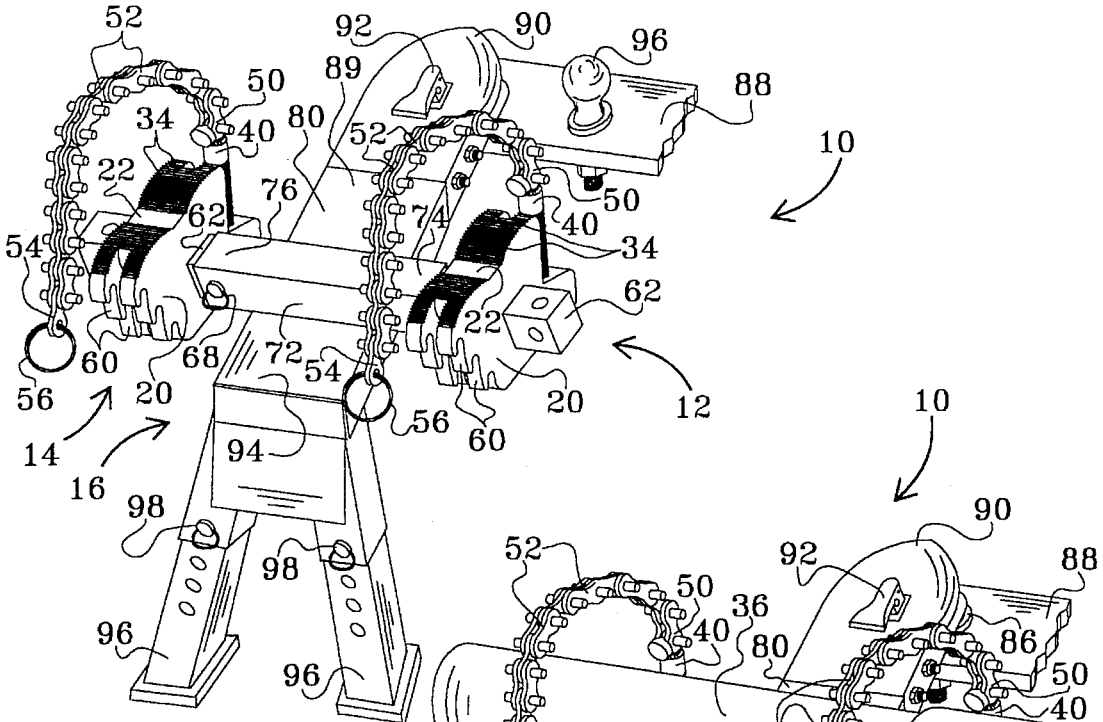
FIG. 3 is a perspective view of the portable chain wrench and vise with the vise mounted on adjustable legs and having a ball socket adapted for receipt on a ball hitch mounted on the rear of a vehicle.

In FIG. 3 the chain wrench and vise 10 has become a portable unit by incorporating the vise base 80 into a stand which can be quickly releasably attached to a ball hitch 86 attached to a bumper 88 at the rear of a service vehicle. A portion of the bumper 88 is shown in FIGS. 3 and 4. In this example, the vise base 80 includes a first end 89 attached to a ball hitch socket 90 with release latch 92. In FIG. 3, the ball hitch socket 90 is shown in position for attachment to the ball hitch 86. A second end 94 of the vise base 80 includes downwardly extending adjustable legs 96. The length of the legs 96 can be adjusted using pins 98. By adjusting the length of the legs 96, the chain wrench and vise 10 can be raised and lowered depending on the height of the ball hitch 86 above the ground surface.

In FIG. 4, the subject invention as shown in FIG. 3 has been attached to the ball hitch 86 of the bumper 88 and the legs 96 have been adjusted in height so that the vise base 80 is level. In this drawing, the workpiece 36, in the form of a section of pipe with a threaded coupling, has been place on top of the gripping teeth 34 of the wrench body 20 of both the first and second chain wrenches 12 and 14. The chains 52 have been positioned around the circumference of the workpiece 36 with the second end 54 of the chains 52 ready to be attached to a selected hook 60.

As mentioned above the subject chain wrench and vise 10 can be used with a single chain wrench or both chain wrenches as shown in FIGS. 2–4. Also, the vise housing 16 may be attached to various work surfaces or become a portable unit as shown in FIGS. 3–4.

While the invention has been particularly shown, described and illustrated in detail with reference to the preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A combination chain wrench and vise apparatus for holding a workpiece, such as a pipe and like object, in place and for engagement around a circumference of the workpiece and performing work thereon, the apparatus comprising:

a chain wrench body, said chain wrench body having a plurality of teeth for releasably engaging and gripping of the workpiece;

a chain, said chain attached at one end to said chain wrench body, said chain adapted for wrapping around the workpiece and securing the workpiece to said chain wrench body;

a first attachment block extending outwardly from said chain wrench body and a second attachment block extending outwardly from said chain wrench body; and a vise attachment tube, said vise attachment tube having a first end for receiving said first attachment block therein and a vise base, said vise attachment tube mounted to a top of said vise base, whereby said vise base may be secured on the top of a work bench, service truck bumper and other flat working surfaces.

2. The apparatus as described in claim 1 wherein said vise attachment tube is angular in construction and said first attachment block includes exterior sides adapted for slidable receipt and in a press fit in the first end of said vise attachment tube.

3. The apparatus as described in claim 1 wherein said vise base is attached to a portable stand having legs which can be adjusted in length.

4. A combination chain wrench and vise apparatus for holding a workpiece, such as a pipe and like object, in place and for engagement around a circumference of the workpiece and performing work thereon, the apparatus comprising:

a first chain wrench body, said first chain wrench body having a front portion with a plurality of teeth for releasably engaging and gripping of the workpiece;

a chain, said chain having a first end adapted for tightening on said first chain wrench body, said chain having a second end which is releasably attached to said first chain wrench body so that a length of the said chain can be adjusted when received around different sizes of the workpiece;

a first attachment block having exterior sides extending outwardly from a top portion of said first chain wrench body;

a second attachment block having exterior sides extending outwardly from a bottom portion of said first chain wrench body;

a vise attachment tube, said vise attachment tube having a first end for receiving the exterior sides of said first attachment block therein; and a vise base, said vise attachment tube mounted to a top of said vise base, whereby said vise base may be secured on the top of a work bench, service truck bumper and other flat working surfaces.

5. The apparatus as described in claim 4 further including a portable stand attached to said vise base, said portable stand having ball hitch attachment means for attachment to a ball hitch at the rear of a service truck.

6. The apparatus as described in claim 5 wherein said portable stand includes a pair of adjustable legs for raising and lowering the height of said portable stand.

7. The apparatus as described in claim 5 wherein said ball hitch attachment means is a ball hitch socket for releasable attachment to the ball hitch at the rear of the service truck.

8. The apparatus as described in claim 4 further including a second chain wrench body, said second chain wrench body having a front portion with a plurality of teeth for releasably engaging and gripping of the workpiece;

a second chain, said second chain having a first end adapted for tightening on said second chain wrench body, said second chain having a second end which is releasably attached to said second chain wrench body so that a length of the said chain can be adjusted when received around different sizes of the workpiece; and a second first attachment block having exterior sides extending outwardly from a top portion of said second chain wrench body, said second first attachment block received in a second end of said vise attachment tube.

9. The apparatus as described in claim 8 further including a second attachment block extending outwardly from a bottom of said second chain wrench body.

10. The apparatus as described in claim 4 wherein said vise attachment tube is angular in construction and the exterior sides of said first attachment block of said first chain wrench body are adapted for slidable receipt and in a press fit in the first end of said vise attachment tube.

11. The apparatus as described in claim 8 wherein said vise attachment tube is angular in construction and the exterior sides of said first attachment block of said second chain wrench body are adapted for slidable receipt and in a press fit in the second end of said vise attachment tube.

12. A combination chain wrench and vise apparatus for holding a workpiece, such as a pipe and like object, in place and for engagement around a circumference of the workpiece and performing work thereon, the apparatus comprising:

a first chain wrench body, said first chain wrench body having a front portion with a plurality of teeth for releasably engaging and gripping of the workpiece;

a first chain, said first chain having a first end adapted for tightening on said first chain wrench body, said chain having a second end which is releasably attached to said first chain wrench body so that a length of the said first chain can be adjusted when received around different sizes of the workpiece;

a first attachment block having exterior sides extending outwardly from a top portion of said first chain wrench body;

a second chain wrench body, said second chain wrench body having a front portion with a plurality of teeth for releasably engaging and gripping of the workpiece;

a second chain, said second chain having a first end adapted for tightening on said second chain wrench body, said second chain having a second end which is releasably attached to said second chain wrench body so that a length of the said second chain can be adjusted when received around different sizes of the workpiece; and a second first attachment block having exterior sides extending outwardly from a top portion of said second chain wrench body, a vise attachment tube, said vise attachment tube having a first end for receiving the exterior sides of said first attachment block of said first chain wrench body therein, and a second end for receiving the exterior sides of said second first attachment block of said second chain wrench body therein;

a vise base, said vise attachment tube mounted to a top of said vise base, whereby said vise base may be secured on the top of a work bench, service truck bumper and other flat working surfaces.

13. The apparatus as described in claim 12 further including a portable stand attached to said vise base, said portable stand having ball hitch attachment means for attachment to a ball hitch at the rear of a service truck.

14. The apparatus as described in claim 13 wherein said portable stand includes a pair of adjustable legs for raising and lowering the height of said portable stand.

15. The apparatus as described in claim 13 wherein said ball hitch attachment means is a ball hitch socket for releasable attachment to the ball hitch at the rear of the service truck.

16. The apparatus as described in claim 12 wherein said vise attachment tube is angular in construction and the exterior sides of said first attachment block of said first chain wrench body are adapted for slidable receipt and in a press fit in the first end of said vise attachment tube and the exterior sides of said second first attachment block of said second chain wrench body are adapted for slidable receipt and in a press fit in the second end of said vise attachment tube.

* * * * *